US006371632B1

(12) United States Patent
Lavy

(10) Patent No.: US 6,371,632 B1
(45) Date of Patent: Apr. 16, 2002

(54) DETACHABLE PENDANT LAMP FOR EASY PACKING ASSEMBLY

(76) Inventor: Danny Lavy, 555 Chabanel Street West, Suite 700, Montreal, Quebec (CA), H2N 2J2

( * ) Notice: Subject to any disclaimer, the term of this patent is extended or adjusted under 35 U.S.C. 154(b) by 0 days.

(21) Appl. No.: 09/670,201

(22) Filed: Sep. 25, 2000

(51) Int. Cl.[7] ..... F21S 8/04

(52) U.S. Cl. ..... 362/406; 362/405; 206/320; 206/592

(58) Field of Search ..... 362/404, 405, 362/406, 450; 206/320, 418, 523, 592

(56) References Cited

U.S. PATENT DOCUMENTS 4,748,549 A * 5/1988 Scheer ..... 362/406

FOREIGN PATENT DOCUMENTS

WO WO 97/49949 * 12/1997

* cited by examiner

*Primary Examiner*—Alan Cariaso
*Assistant Examiner*—Hargobind S. Sawhney
(74) *Attorney, Agent, or Firm*—Raymond Y. Chan; David and Raymond

(57) ABSTRACT

A detachable pendent lamp for easy packing assembly includes a die cast pan having a base bulb casing mounted thereunder, a plurality of light chandeliers detachably and outwardly extended from the pan wherein each light chandelier has a bulb connector mounted on an outer end thereof, a lamp shade detachably attached to the bulb connector, a hanging means for hanging the pendant lamp from a ceiling base to the pan, and a plurality of connecting wires integrally connected to the light bulbs, whereby the pendent lamp is packed in a packing container having a pan cavity provided at a center thereof for receiving the pan therein. The detached light chandeliers and the hanging means are placed inside the pan, and a plurality of shade chambers encirclingly mounted around the pan cavity for disposing the lamp shades therein, so that the container has a height slightly larger than a height of the pan for saving the packing space.

8 Claims, 4 Drawing Sheets

DETACHABLE PENDANT LAMP FOR EASY PACKING ASSEMBLY

BACKGROUND OF THE PRESENT INVENTION

1. Field of Invention

The present invention relates to packing assembly, and more particularly to a detachable pendant lamp for easy packing assembly which is capable of saving packing space for easy carriage and transportation.

2. Description of Related Arts

People have used pendant lamp at home, church, or other places of commerce to to provide an atmospheric or decorative touch. A pendant lamp usually comprises a die cast pan having a base bulb casing mounted thereunder for placing a base light bulb therein, a plurality of light chandeliers outwardly extended from a top of the pan wherein each light chandelier has a bulb connector attached at its outer ends thereof, a lamp shade detachably mounted on each bulb connector, a hanging chain for hanging the pendant lamp from a ceiling securely attached on the top of the pan, and a plurality of connecting wires for electrically connecting to the light bulbs mounted inside the pendant lamp.

In order to store and deliver the pendent lamp, the pendent lamp is usually packed in a box made of foam material for avoiding any damage of the pendent lamp. However, a conventional pendent lamp cannot be disassembled such that when it is packed in the box, it occupies lots of packing space. Furthermore, even though the pendent lamp is light, the box must have a dimension larger than the size of the entire pendent lamp. So, the cost of the box and the shipping fee will be increase because of the relatively huge size of the box.

For decreasing the cost of the packaging of the pendent lamp, an improved structure of the pendent lamp is designed wherein all parts of the pendent lamp cannot be disassembled such as the light chandeliers, the lamp shades and the hanging chain such that the pendent lamp is packed into the box part by part and assembled to its original form when it is used. Since the pendent lamp is disassembled into small pieces, the parts of the pendent lamp can be compactly packed into the box. So, the size of the box may obviously small that can be easily transportation and storage. However, the parts of the pendent lamp such as light chandeliers have the connecting wires mounted therein for electrically connecting the light bulbs. In other words, if the parts of the pendent lamp are disassembled, the wires inside the parts must be disconnected as well. Finally, when users want to assemble the pendent lamp to its original form, they must connect the wires in order to lighten the light bulb. It is dangerous that many users have not enough knowledge and technique to connect such wires. Worse, the users may get an electric shock if one of the wires does not connected properly.

SUMMARY OF THE PRESENT INVENTION

A main object of the present invention is to provide a detachable pendant lamp for easy packing assembly which can be easily disassembled for storage and carriage and assembled for use.

Another object of the present invention is to provide a detachable pendant lamp for easy packing assembly which is capable of saving packing space for easy carriage and transportation.

Another object of the present invention is to provide a detachable pendant lamp for easy packing assembly wherein the pendent lamp is adapted to be assembled and disassembled without using any tools.

Accordingly, in order to accomplish the above objects, the present invention provides a detachable pendent lamp packing assembly, which comprises:

a pendent lamp, comprising a die cast pan having a base bulb casing mounted thereunder for installing at least a base bulb connector therein for electrically connecting a base light bulb, wherein an interior chamber having a top opening is defined in the pan, a plurality of hollow light chandeliers each having a first end detachably connected to a top end of the pan and a second end extended outwardly to connect a bulb connector for electrically connecting with a chandelier light bulb, a plurality of lamp shades detachably attached to the bulb connectors respectively, a ceiling base for affixing to a ceiling and electrically connecting with a power source provided in the ceiling, a hanging means for hanging the pan from the ceiling base, and a plurality of connecting wires extending from the ceiling base for electrically connecting for connecting with the base bulb connector in the pan via the hanging means and the bulb connectors by passing through the light chandeliers respectively; and a packing container for packing the pendent lamp while the first ends of the light chandeliers are detached from the pan while the respective connecting wires are remained connecting between the pan and the bulb connectors through the light chandeliers respectively, wherein the packing container comprising an exterior box and a filler, made of foam material, being fittingly received in the exterior box, having a pan cavity, which has a depth slightly larger than a height of the pan, receiving the pan therein while the ceiling base, the hanging means, the plurality of light chandeliers, and the bulb connectors are placed inside the pan, and a plurality of shade chambers encirclingly provided around the pan cavity to fittingly receive the lamp shades therein respectively.

DETAILED DESCRIPTION OF THE PREFERRED EMBODIMENT

Figure 1:
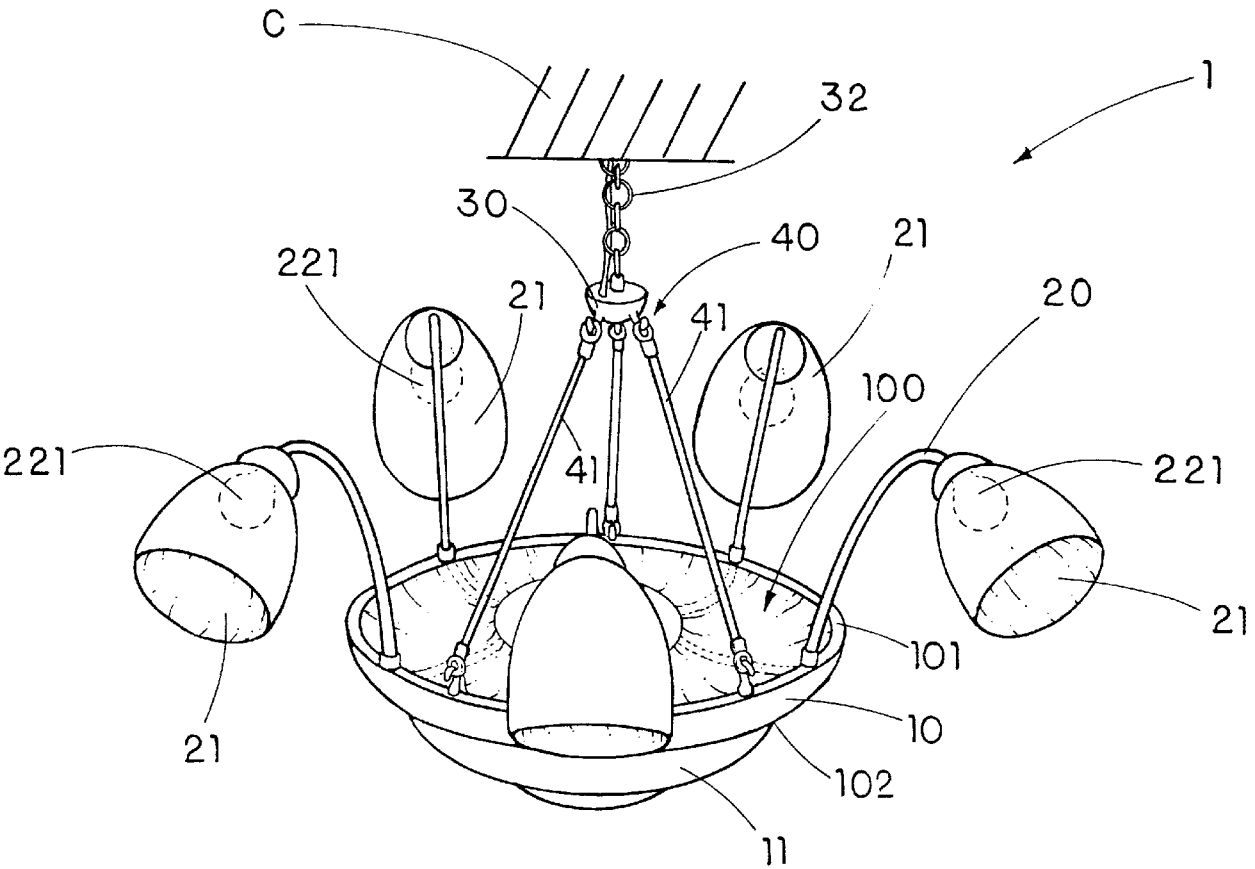
FIG. 1 is a perspective view of a detachable pendent lamp for easy packing assembly according to a preferred embodiment of the present invention.
Figure 2:
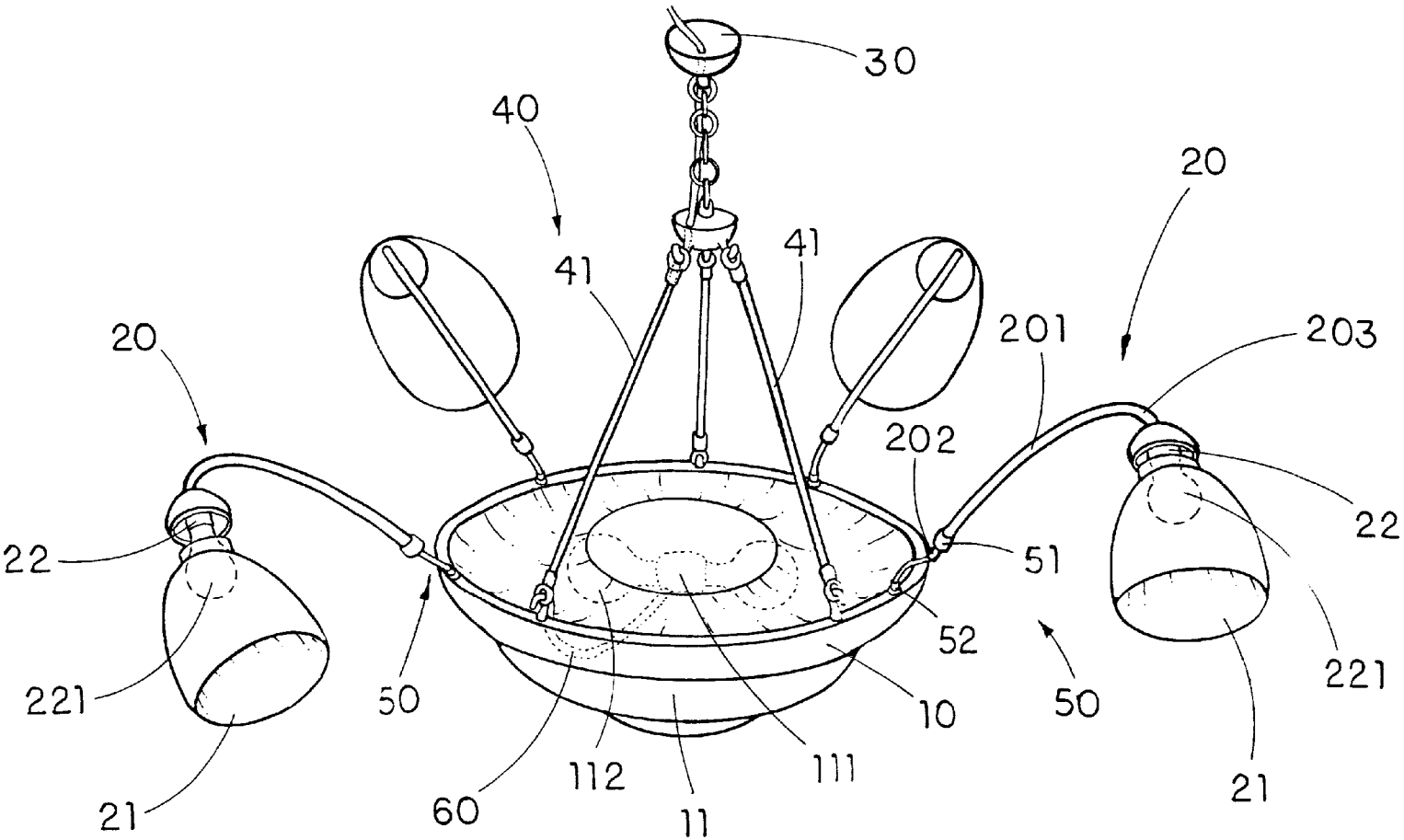
FIG. 2 is an exploded front view of the detachable pendent lamp according to the above preferred embodiment of the present invention.
Figure 3:
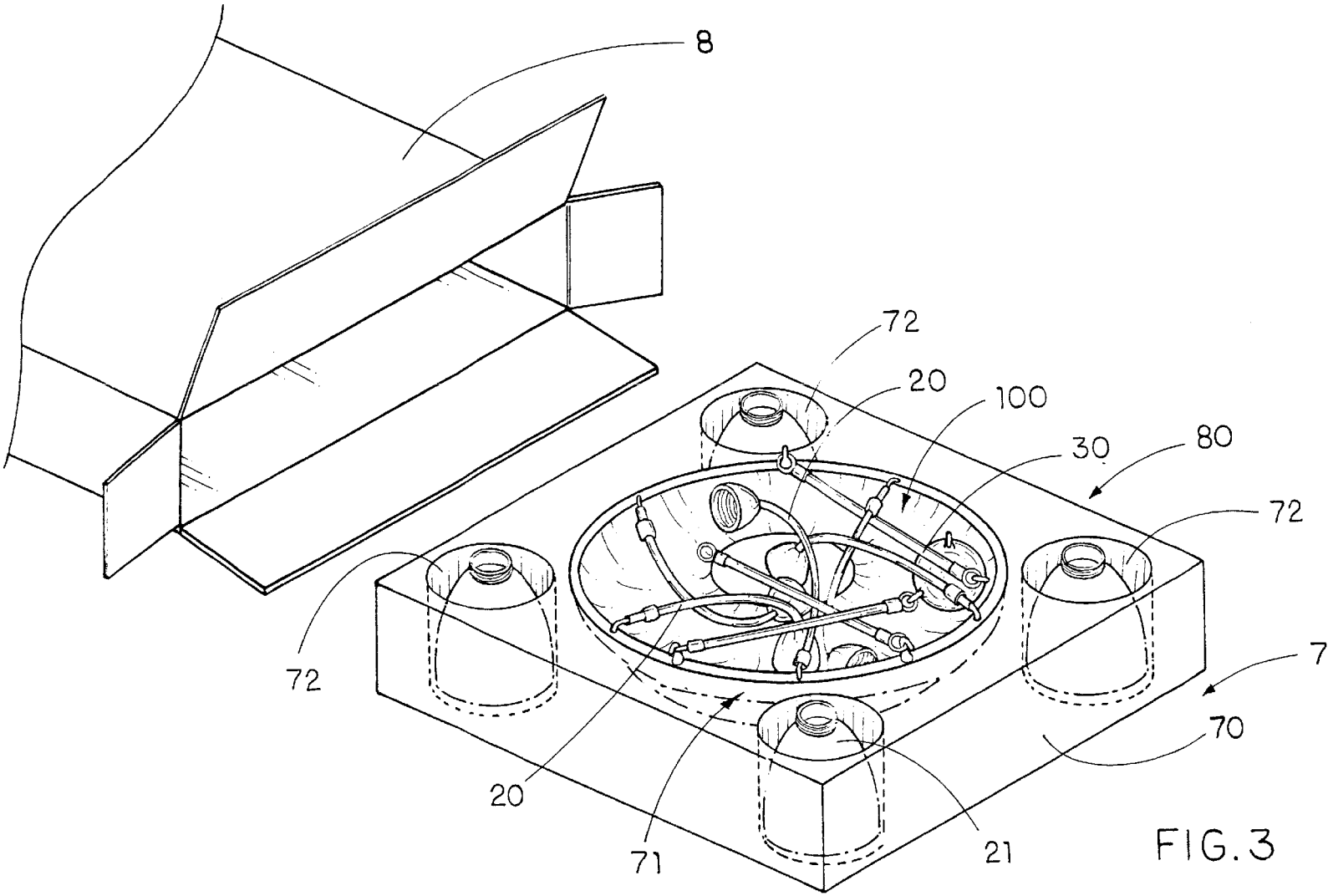
FIG. 3 is a perspective view of the detachable pendent lamp packing assembly according to the above preferred embodiment of the present invention, illustrating the pendent lamp packed in the packing container.

Referring to FIGS. 1 to 3, a detachable pendent lamp 1 according to a preferred embodiment of the present invention is illustrated, which comprises a die cast pan 10 having a base bulb casing 11 mounted thereunder for placing at least a base bulb connector 111 therein for electrically connecting with a base light bulb 112 and defining an interior chamber 100 therein, a plurality of hollow light chandeliers 20 each having a first end 202 detachably connected to a top end of the pan 10 and a second end 203 extended outwardly to connect a bulb connector 22 for electrically connecting with a chandelier light bulb 221, a plurality of lamp shades 21 detachably attached to the bulb connectors 22 respectively, a ceiling base 30 for affixing to a ceiling C and electrically connecting with a power source provided in the ceiling C, a hanging means 40 for hanging the pan 10 of the pendant lamp 1 from the ceiling base 30, and a plurality of connecting wires 60 extending from the ceiling base 30 for electrically connecting for connecting with the base bulb connector 111 in the pan via the hanging means 40 and the bulb connectors 22 by passing through the light chandeliers 20 respectively.

Referring to FIG. 2 of the drawings, the pan 10 having a circular dish shaped has a top end 101 and a bottom end 102, wherein the base bulb casing 11 having a circular dish shaped is detachably mounted under the bottom end 102 of the pan 10 for installing the replaceable base light bulb 112 in the base bulb casing 11 to connect with the base bulb connector 111 provided in the pan 10.

There are preferably four light chandeliers 20 provided in the preferred embodiment as shown in FIGS. 1 to 3. Each of the light chandeliers 20 comprises a tubular body 201, wherein each of the first ends 202 is detachably connected to the top end 101 of the pan while each of the second ends 203 is detachably connected to the respective bulb connector 22 by fastening device such as bolt and nut connection. The bulb connector 22 is preferred integrally connected to the second end 203 of each of the light chandeliers 20 for connecting a replaceable light bulb 221. Each of the lamp shades 21 can be a cone shaped, preferably made of glass, and is detachably mounted on the respective bulb connector 22 by screws.

Figure 4:
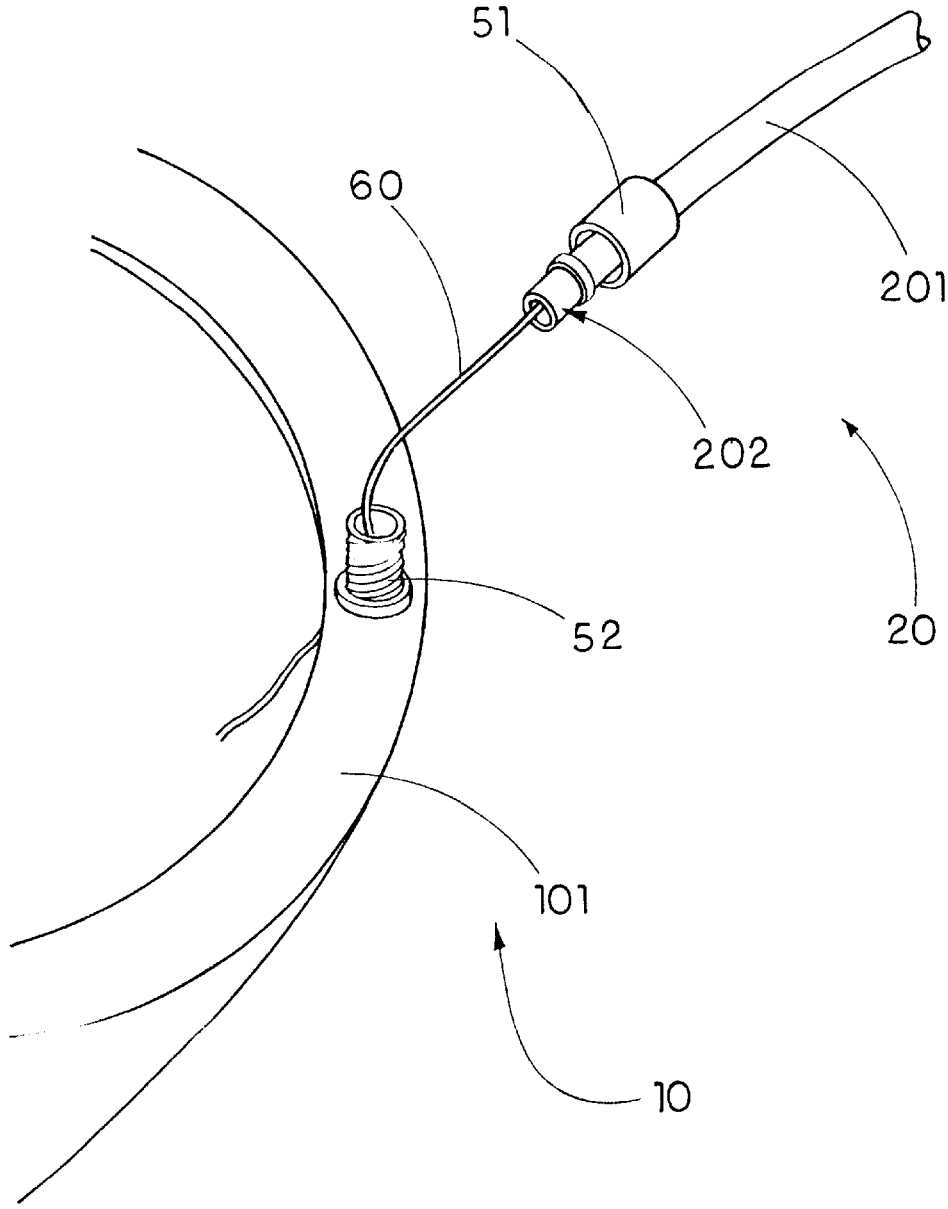
FIG. 4 is an enlarged view of the fastening device of the detachable pendent lamp packing assembly according to the above preferred embodiment of the present invention.

The fastening device 50, as shown in FIG. 4, comprises a tubular mounting nut 51 slidably mounted on the first end 202 of each of the light chandeliers 20 and a hollow cylindrical mounting bolt 52 securely mounted on the top end 101 of the pan 10, wherein the mounting nut 51 has an inner threaded portion for screwing with an outer threaded portion of the mounting bolt 52. The mounting bolt 52 has an inner circumference slightly bigger than a circumference of the light chandelier 20 such that the light chandelier 20 is adapted to be fitly inserted into the mounting bolt 52. Moreover, the mounting nut 51 has a diameter slightly larger than a diameter of the light chandelier 20 such that the first end 202 of the mounting nut 51 is adapted to be slid along the tubular body 201 of the light chandelier 20. So, each of the light chandeliers 20 is inserted into the respective mounting bolt 52 and is tighten by screwing the respective mounting nut 51 on the mounting bolt 52 so as to securely attach the light chandelier 20 on the pan 10.

The hanging means 40 comprises a plurality of hollowing hanging tubes 41 each having a bottom end evenly and detachably mounted on the top end 101 of the pan and a top end attached to the ceiling base 30. A ceiling chain 32 can be used to downwardly suspend the ceiling base 30 from the ceiling C.

Each of the top end and the bottom end of each of the hanging tubes 41 has a hanging ring 42 rotatably mounted thereto, wherein each hanging ring 42 on the end of the hanging tube 41 is arranged to be detachably hooked on a hanging hook 43 mounted on the top end 101 of the pan 10 and the ceiling base 30 for connecting between the pan 10 and the ceiling base 30.

The connecting wires 60 are extended from the ceiling base 30 to the pan 10 inside through one of the hanging tubes 41 and then further extended to the bulb connectors 22 through the light chandeliers 20 respectively. In such arrangement, the connecting wires 60 are remained linking between the light chandeliers 20 and the pan 10 while the light chandeliers 20 are detached from the pan 10. So, a user does not have to connect the connecting wires 60 by himself or herself when assembling the pendent lamp 1.

In order to pack the pendent lamp 1 efficiently, the assembly parts of the pendent lamp 1 must be in well arrangement and easy to assemble back to its original form. Referring to FIG. 3 of the drawing, a packing container 7 is provided for the pending lamp 1 to form the detachable pendant lamp packing assembly according to the present invention. The packing container 7 comprises an exterior box 8 and a filler 80, made of foam material, being fittingly received in the exterior box 8. The filler 80, having a predetermined dimension of square shape, provides a circular pan cavity 71 at a center thereon and a plurality of circular shade chambers 72 provided at four corners of the container 7 respectively.

While packing the pendent lamp 1 of the present invention, each of the detached light shades 21 is fitly disposed in the shade chamber 72 and the pan 10 of the pendent lamp 1 is fitly received in the pan cavity 71 wherein the light chandeliers 20 and the hanging means 40 are detached and placed within the interior chamber 100 of the pan 10 via a top opening of the interior chamber 100, so that the disassembled pendent lamp 1 is taken less spaces.

Accordingly, the light shades 21 are detached from the light chandeliers 20 by unscrewing the light shades 21 so that the light shades 21 are placed in the shade chambers provided in the packing container 7 at the four corners thereof. Each of the light chandeliers 20 is detached from the pan 10 by detaching the fastening device 50 wherein the mounting nut 51 is arranged to be unscrewed from the mounting bolt 52 such that the light chandelier 20 is adapted to be detached from the pan 10. Moreover, each of the hanging tubes 41 is detached from the pan 10 by unhooking the hanging rings 311 of the hanging tubes 41 from the hanging hook 43 on the pan 10 and on the ceiling base 30 respectively, wherein the detached light chandeliers 20 and the detached hanging tubes 41 are disposed inside the interior chamber 100 of the pan 10. However, the connecting wires 60 are still connected through the respective parts such as the light chandeliers 20 and the hanging tubes 41 such that no wire is needed to be re-connected while assembling the pendent lamp 1.

So, the dimension of the container 7 can be highly decreased for storing the pendent lamp 1 wherein the container 7 has a height slightly higher than a height of the pan 10 and the container 7 has a width shorter than total diameters of the pan 10 and the two light shades 21.

In view of above, the present invention can substantially achieve the flowing advantages:

1. The detachable pendent lamp of the present invention is easy to disassemble and pack in the container for storage and transportation, and assemble back for use.
2. The detachable pendent lamp would not occupy space when it is disassembled so that the pendent lamp can be efficiently packed in the relative small size of the container.

3. The assembly parts of the detachable pendent lamp such as the light chandeliers and the hanging chain can be detached from the pan without disconnecting the connecting wire linked therebetween.

4. The detachable pendent lamp can be assembled and disassembled without using any tools.

What is claimed is:

1. A detachable pendent lamp packing assembly, comprising:

a pendent lamp which comprises:

a die cast pan having a base bulb casing mounted thereunder for installing at least a base bulb connector therein for electrically connecting a base light bulb, wherein an interior chamber having a top opening is defined in said pan, a plurality of hollow light chandeliers each having a first end detachably connected to a top end of said pan and a second end extended outwardly to connect a bulb connector for electrically connecting with a chandelier light bulb, a plurality of lamp shades detachably attached to said bulb connectors respectively, a ceiling base for affixing to a ceiling and electrically connecting with a power source provided in said ceiling, a hanging means for hanging said pan from said ceiling base, and a plurality of connecting wires extending from said ceiling base for electrically connecting for connecting with said base bulb connector in said pan via said hanging means and said bulb connectors by passing through said light chandeliers respectively; and a packing container for packing said pendent lamp while said first ends of said light chandeliers are detached from said pan while said respective connecting wires are remained connecting between said pan and said bulb connectors through said light chandeliers respectively, wherein said packing container comprising an exterior box and a filler, made of foam material, being fittingly received in said exterior box, having:

a pan cavity, which has a depth slightly larger than a height of said pan, receiving said pan therein while said ceiling base, said hanging means, said plurality of light chandeliers, and said bulb connectors are placed inside said interior chamber of said pan, and a plurality of shade chambers encirclingly provided around said pan cavity to fittingly receive said lamp shades therein respectively.

2. A detachable pendant lamp packing assembly, as recited in claim 1, wherein said first end of each of said light chandeliers is detachably connected to said top end of said pan by means of a fastening device which comprises a tubular mounting nut slidably mounted on said first end of said light chandelier and a hollow cylindrical mounting bolt securely mounted on said top end of said pan, wherein said mounting nut has an inner threaded portion for screwing with an outer threaded portion of said mounting bolt, wherein said mounting bolt has an inner circumference slightly bigger than a circumference of said light chandelier and thus said light chandelier is adapted to be fitly inserted into said mounting bolt, wherein said mounting nut has a diameter slightly larger than a diameter of said light chandelier and thus said first end of said mounting nut is adapted to be slid along said tubular body of said light chandelier, wherein each of said light chandeliers is inserted into said respective mounting bolt and is tighten by screwing said respective mounting nut on said mounting bolt so as to securely attach said light chandelier on said pan.

3. A detachable pendant lamp packing assembly, as recited in claim 2, wherein said hanging means comprises a plurality of hollowing hanging tubes each having a bottom end evenly and detachably mounted on said top end of said pan and a top end attached to said ceiling base.

4. A detachable pendant lamp packing assembly, as recited in claim 3, wherein each of said top end and said bottom end of each of said hanging tubes has a hanging ring rotatably mounted thereto, wherein each of said hanging rings on said end of said hanging tube is arranged to be detachably hooked on a hanging hook mounted on said top end of said pan and said ceiling base for connecting between said pan and said ceiling base.

5. A detachable pendant lamp packing assembly, as recited in claim 1, wherein said hanging means comprises a plurality of hollowing hanging tubes each having a bottom end evenly and detachably mounted on said top end of said pan and a top end attached to said ceiling base.

6. A detachable pendant lamp packing assembly, as recited in claim 5, wherein each of said top end and said bottom end of each of said hanging tubes has a hanging ring rotatably mounted thereto, wherein each of said hanging rings on said end of said hanging tube is arranged to be detachably hooked on a hanging hook mounted on said top end of said pan and said ceiling base for connecting between said pan and said ceiling base.

7. A detachable pendant lamp packing assembly, as recited in claim 1, wherein each of said top end and said bottom end of each of said hanging tubes has a hanging ring rotatably mounted thereto, wherein each of said hanging rings on said end of said hanging tube is arranged to be detachably hooked on a hanging hook mounted on said top end of said pan and said ceiling base for connecting between said pan and said ceiling base.

8. A detachable pendant lamp packing assembly, as recited in claim 2, wherein each of said top end and said bottom end of each of said hanging tubes has a hanging ring rotatably mounted thereto, wherein each of said hanging rings on said end of said hanging tube is arranged to be detachably hooked on a hanging hook mounted on said top end of said pan and said ceiling base for connecting between said pan and said ceiling base.

* * * * *